US011576542B2

(12) United States Patent
Koura et al.

(10) Patent No.: US 11,576,542 B2
(45) Date of Patent: Feb. 14, 2023

(54) ROBOTIC DUST COLLECTOR

(71) Applicant: MAKITA CORPORATION, Anjo (JP)

(72) Inventors: Kentaro Koura, Anjo (JP); Hirotaka Sumiyoshi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 667 days.

(21) Appl. No.: 16/672,685

(22) Filed: Nov. 4, 2019

(65) Prior Publication Data

US 2020/0138257 A1 May 7, 2020

(30) Foreign Application Priority Data

Nov. 7, 2018 (JP) ..... JP2018-210010

(51) Int. Cl.
*A47L 9/14* (2006.01)

(52) U.S. Cl.
CPC ..... *A47L 9/1445* (2013.01); *A47L 2201/00* (2013.01)

(58) Field of Classification Search
CPC . A47L 11/4063; A47L 2201/00; A47L 9/1445
See application file for complete search history.

(56) References Cited

U.S. PATENT DOCUMENTS 8,874,268 B2 * 10/2014 Kim ..... A47L 5/28 15/340.1
10,342,400 B2 * 7/2019 Nam ..... A47L 9/2873
10,485,394 B2 * 11/2019 Hu ..... A47L 9/1409
2007/0180647 A1 * 8/2007 Hamm ..... A47L 9/2889 15/327.7
2012/0023699 A1 * 2/2012 Shim ..... A47L 9/00 15/319
2012/0095597 A1 * 4/2012 Kim ..... A47L 9/1472 700/258
2015/0265120 A1 * 9/2015 Han ..... B01D 46/48 55/482

FOREIGN PATENT DOCUMENTS

CN 1698529 A 11/2005
CN 1913820 A 2/2007
CN 202714800 U 2/2013
(Continued)

OTHER PUBLICATIONS

JP-2010023388-A—English Machine Translation (Year: 2010).*
(Continued)

*Primary Examiner* — Marc Carlson
(74) *Attorney, Agent, or Firm* — Oliff PLC

(57) ABSTRACT

A robotic dust collector includes: a cover plate that closes an opening of a housing; a first hinge member connected to the cover plate and having an insertion space; an elastic member disposed in the insertion space; and a second hinge member. The second hinge member includes a shaft part that is inserted in the insertion space and supports the elastic member. The second hinge member further includes a fixture part fixed to at least a part of the housing. The second hinge member supports the first hinge member in a manner that allows the first hinge member to rotate about a rotation axis.

17 Claims, 13 Drawing Sheets

(56) References Cited

FOREIGN PATENT DOCUMENTS

| | | | | | |
|---|---|---|---|---|---|
| CN | 205181233 | U | | 4/2016 | |
| CN | 106568289 | A | | 4/2017 | |
| CN | 206174739 | U | * | 5/2017 | |
| CN | 206174739 | U | | 5/2017 | |
| CN | 208441629 | U | * | 1/2019 | |
| DE | 19531888 | A1 | * | 12/1996 | ..... A47L 9/1427 |
| DE | 20 2013 1 05 658 | U1 | | 3/2014 | |
| EP | 1 191 289 | A2 | | 3/2002 | |
| JP | 2010-023388 | A | | 2/2010 | |
| JP | 2010023388 | A | * | 2/2010 | |
| KR | 10-2010-0018785 | A | | 2/2010 | |
| KR | 10-2012-0055612 | A | | 5/2012 | |
| WO | 2017/150867 | A2 | | 9/2017 | |

OTHER PUBLICATIONS

Jun. 14, 2022 Office Action issued in Japanese Patent Application No. 2018-210010.

Oct. 27, 2021 Office Action issued in Chinese Patent Appliaction No. 201911021128.5.

Jul. 14, 2022 Office Action issued in Korean Patent Application No. 10-2019-0141164.

Oct. 4, 2022 Office Action issued in Japanese Patent Application No. 2018-210010.

* cited by examiner

ROBOTIC DUST COLLECTOR

CROSS-REFERENCE TO RELATED APPLICATION(S)

The present application claims priority to and incorporates by reference the entire contents of Japanese Patent Application No. 2018-210010 filed in Japan on Nov. 7, 2018.

BACKGROUND OF THE INVENTION

1. Field of the Invention

The present disclosure relates to a robotic dust collector.

2. Description of the Related Art

In the technology field related to robotic dust collectors, a robotic dust collector is known that includes a first cover, a second cover coupled to the first cover via a hinge part, and an elastic member that provides elasticity for opening the second cover. A user of the robotic dust collector opens the second cover to take a dust box out from inside the first cover and place the dust box inside the first cover.

An example of such a robotic dust collector is disclosed in the specification of U.S. Pat. No. 8,874,268.

In a case where an elastic member is disposed in the hinge part, the hinge part may become large in size. Furthermore, depending on the structure of the hinge part, such arranging can adversely affect assembly work efficiency when the first cover and the second cover are coupled together.

An aspect of the present disclosure has an object to, in a configuration having an elastic member disposed in a hinge part, prevent the hinge part from being large in size and improving assembly work efficiency.

SUMMARY OF THE INVENTION

According to an aspect of the present disclosure, a robotic dust collector includes: a cover plate that closes an opening of a housing; a first hinge member connected to the cover plate and having an insertion space; an elastic member disposed in the insertion space; and a second hinge member. The second hinge member includes a shaft part that is inserted in the insertion space and supports the elastic member. The second hinge member further includes a fixture part fixed to at least a part of the housing. The second hinge member supports the first hinge member in a manner that allows the first hinge member to rotate about a rotation axis.

DETAILED DESCRIPTION OF THE PREFERRED EMBODIMENTS

First Embodiment

Robotic Dust Collector

Figure 1:
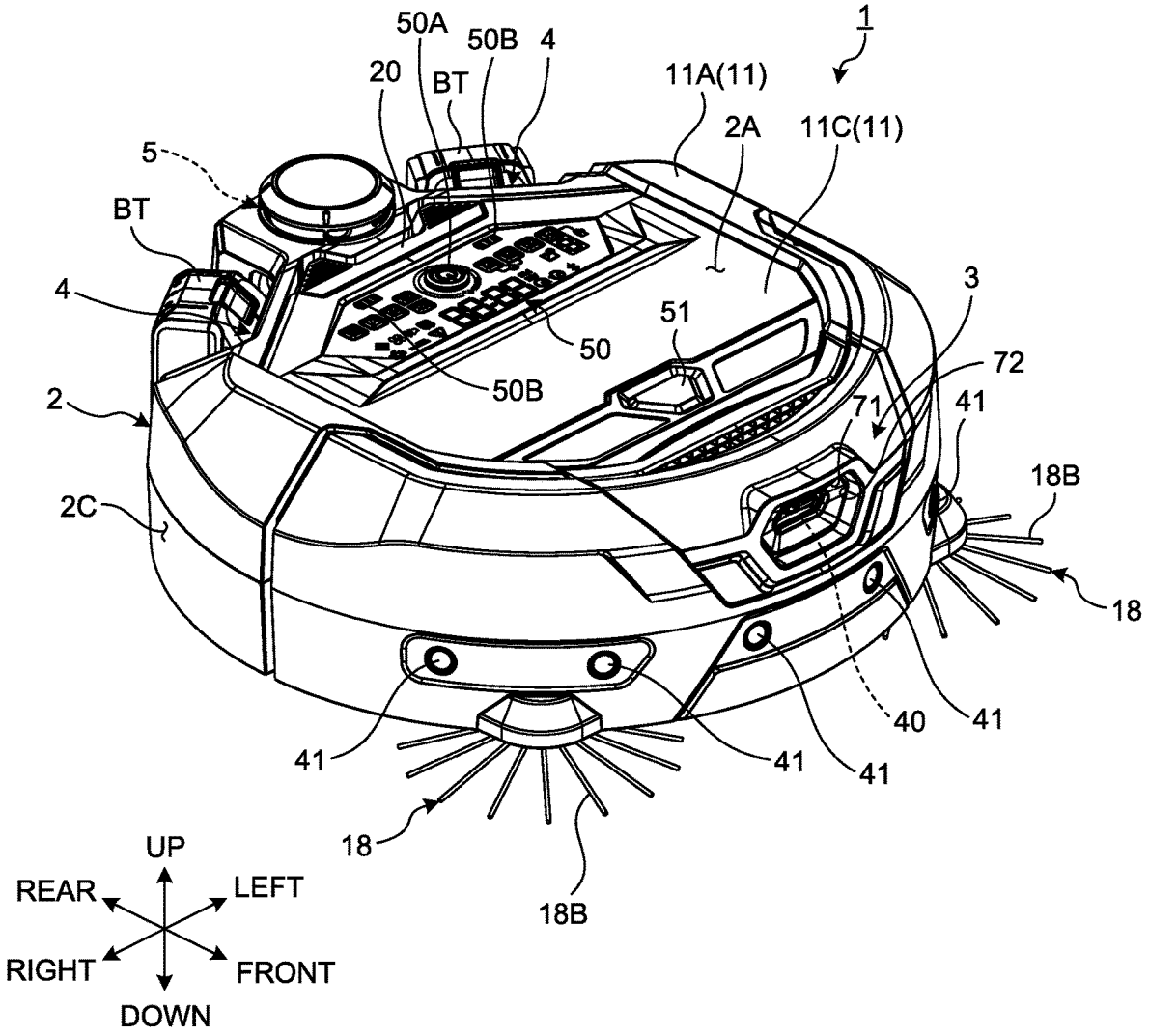
FIG. 1 is a perspective view of a robotic dust collector according to a first embodiment.
Figure 2:
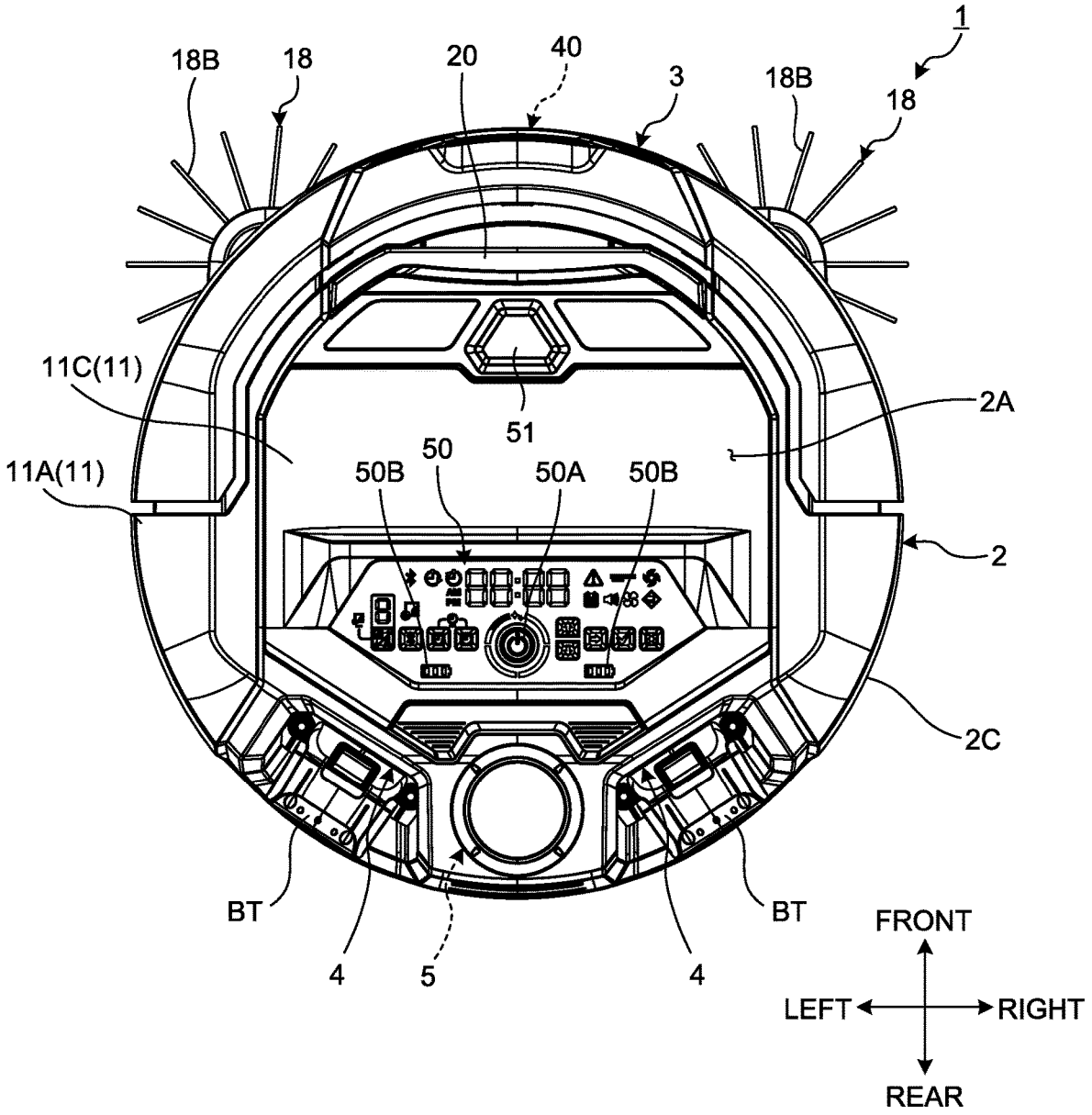
FIG. 2 is a top view of the robotic dust collector according to the first embodiment.
Figure 3:
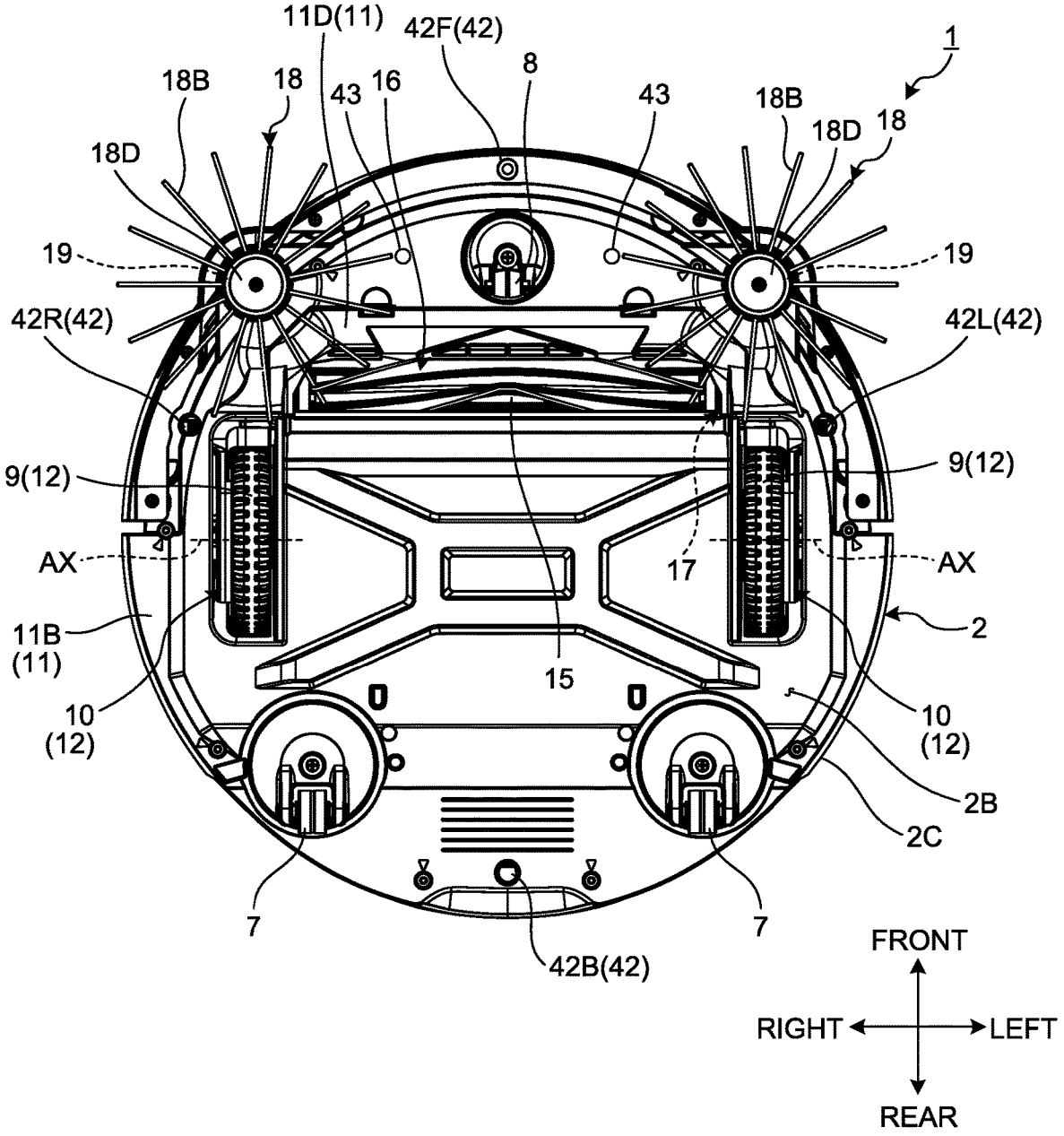
FIG. 3 is a bottom view of the robotic dust collector according to the first embodiment.
Figure 4:
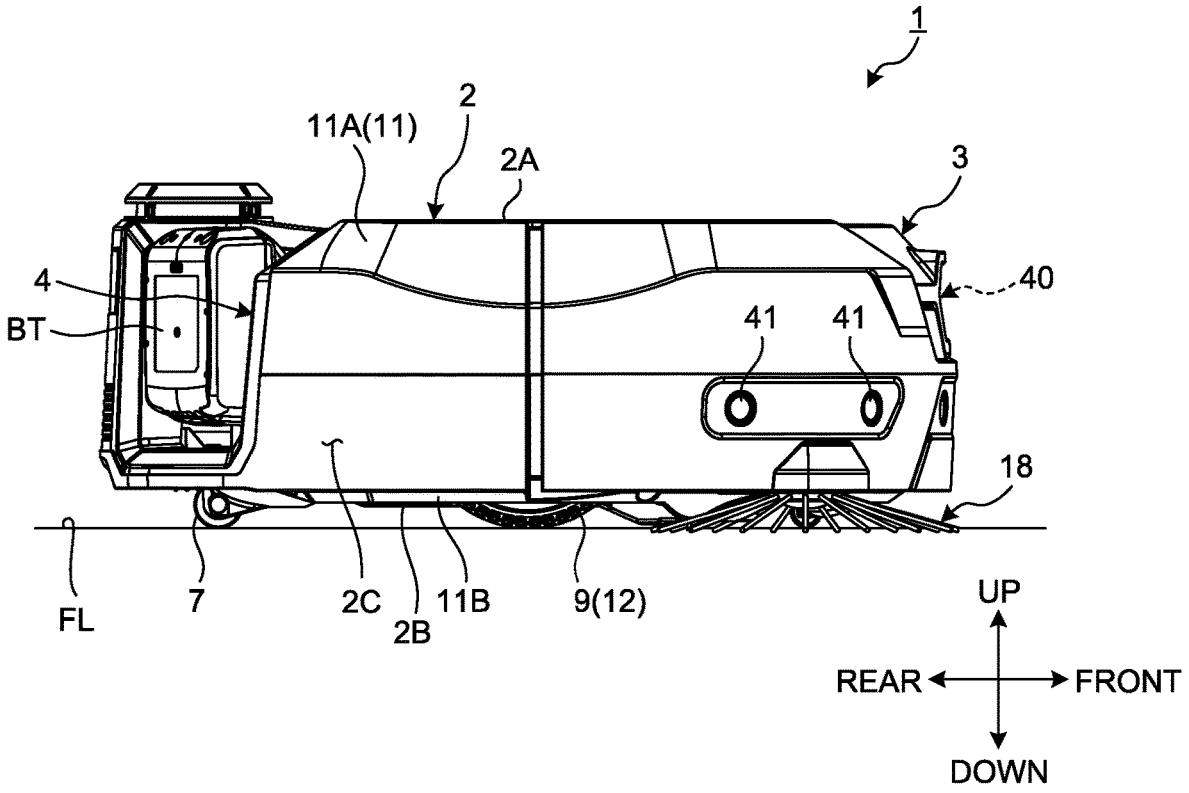
FIG. 4 is a side view of the robotic dust collector according to the first embodiment.
Figure 5:
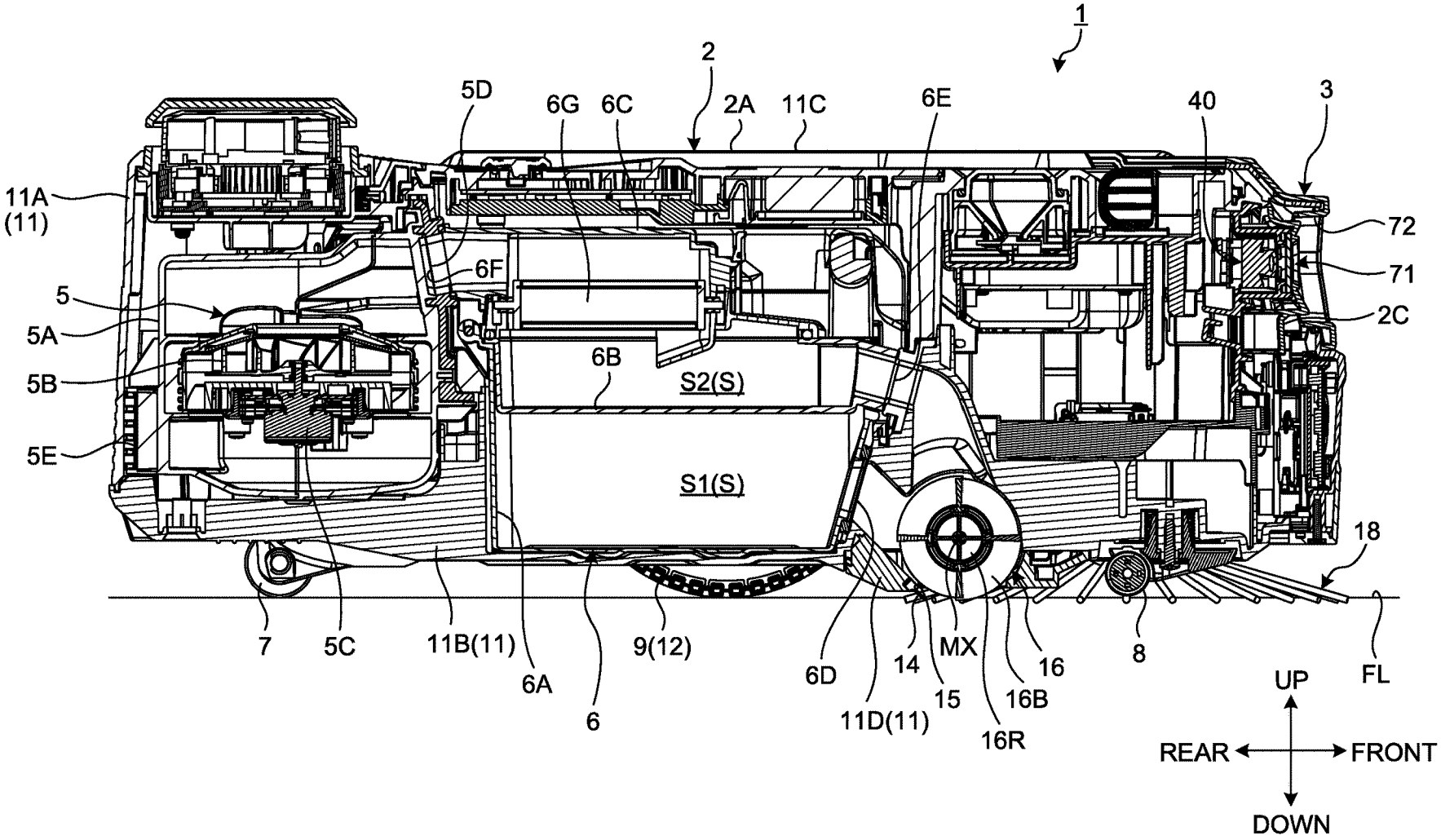
FIG. 5 is a sectional view of the robotic dust collector according to the first embodiment.

FIG. 1 is a perspective view of a robotic dust collector 1 according to the present embodiment. FIG. 2 is a top view of the robotic dust collector 1 according to the present embodiment. FIG. 3 is a bottom view of the robotic dust collector 1 according to the present embodiment. FIG. 4 is a side view of the robotic dust collector 1 according to the present embodiment. FIG. 5 is a sectional view of the robotic dust collector 1 according to the present embodiment.

In the present embodiment, positional relations between components will be described using the terms "left", "right", "front (ahead)", "rear (behind)", "up (top)", and "down (bottom)". These terms refer to relative positions or directions, with the center of the robotic dust collector 1 as a reference.

The robotic dust collector 1 collects dust while autonomously traveling on a cleaning target floor FL. As illustrated in FIG. 1, FIG. 2, FIG. 3, FIG. 4, and FIG. 5, the robotic dust collector 1 includes a body 2, a bumper 3, battery mounting units 4, a fan unit 5, a dust box 6, casters 7, a roller 8, a travel device 12, a main brush 16, a main brush motor 17, a guide member 14, side brushes 18, side brush motors 19, a handle 20, an optical sensor 40, object sensors 41, fall prevention sensors 42, member sensors 43, and an interface device 50.

The body 2 has a top face 2A, a bottom face 2B facing the cleaning target floor FL, and a side face 2C that connects the edge of the top face 2A and the edge of the bottom face 2B. In a plane parallel to the top face 2A, the body 2 has a substantially circular shape.

The body 2 includes a housing 11 having an internal space. The housing 11 includes: an upper housing 11A; a lower housing 11B disposed below the upper housing 11A and connected to the upper housing 11A; a cover plate 11C detachably mounted on the upper housing 11A; and a bottom plate 11D attached to the lower housing 11B. The top face 2A is disposed in the upper housing 11A and the cover plate 11C. The bottom face 2B is disposed in the lower housing 11B and the bottom plate 11D.

The body 2 has a suction inlet 15 in the bottom face 2B. The suction inlet 15 is provided through the bottom plate 11D. The suction inlet 15 sucks dust and dirt on the cleaning target floor FL. The suction inlet 15 faces the cleaning target floor FL. The suction inlet 15 is provided in a front portion of the bottom face 2B. The suction inlet 15 has a rectangular shape elongated in left and right directions. In the left and right directions, the center of the suction inlet 15 coincides with the center of the body 2. The center of the suction inlet 15 does not necessarily coincide with the center of the body 2.

The bumper 3 can be moved while facing at least a part of the side face 2C. The bumper 3 is movably supported by the body 2. The bumper 3 faces a front portion of the side face 2C. Upon colliding with an object present around the robotic dust collector 1, the bumper 3 moves relative to the body 2, thereby absorbing an impact that acts on the body 2.

The battery mounting units 4 support batteries BT. The batteries BT are mounted on the battery mounting units 4. The battery mounting units 4 are provided on at least parts of the outer surface of the body 2. Recesses are provided in the rear portion of the upper housing 11A. The battery mounting units 4 are provided inside the respective recesses in the upper housing 11A. Two battery mounting units 4 in total are provided.

The batteries BT mounted on the battery mounting units 4 supply electric power to an electric device or an electronic device mounted on the robotic dust collector 1. The batteries BT are batteries for use in electric power tools. The batteries BT include a lithium-ion batteries to be used as a power source for electric power tools. The batteries BT include rechargeable batteries that can be recharged. The battery mounting units 4 have the same structure as a battery mounting unit of an electric power tool.

A user of the robotic dust collector 1 can perform, in a space outside of the housing 11, work of mounting the batteries BT in the battery mounting units 4 and removing the batteries BT from the battery mounting unit 4. The battery mounting unit 4 includes a guide member that guides the battery BT to be mounted thereon, and a body-side terminal connected to a battery-side terminal provided to the battery BT. The user can mount the battery BT on the battery mounting unit 4 by inserting the battery BT from above into the battery mounting unit 4. The battery BT is inserted into the battery mounting unit 4 by being guided by the guide member. With the battery BT mounted on the battery mounting unit 4, the battery-side terminal of the battery BT is electrically connected to the corresponding body-side terminal of the battery mounting unit 4. The user of the robotic dust collector 1 can remove the battery BT from the battery mounting unit 4 by moving the battery BT upward.

The fan unit 5 is accommodated in the body 2. The fan unit 5 generates, at the suction inlet 15, suction power for sucking dust and dirt. The fan unit 5 is disposed in the internal space of the housing 11. The fan unit 5 is disposed between two battery mounting units 4 in a rear portion of the body 2. The fan unit 5 is connected to the suction inlet 15 via the dust box 6. The fan unit 5 generates, via the dust box 6, suction power for sucking dust and dirt at the suction inlet 15.

As illustrated in FIG. 5, the fan unit 5 includes: a casing 5A disposed in the internal space of the housing 11; a suction fan 5B provided inside the casing 5A; and a suction motor 5C that generates motive power to rotate the suction fan 5B. The casing 5A includes: an air inlet 5D connected to the dust box 6; and an air outlet 5E.

The suction motor 5C is driven by electric power supplied from the batteries BT. When the suction fan 5B rotates with the suction motor 5C driven, an airstream is generated from the air inlet 5D toward the air outlet 5E. The air inlet 5D is connected to the suction inlet 15 via the dust box 6. When the suction fan 5B rotates, an airstream is generated from the suction inlet 15 toward the air outlet 5E. As a result, the suction power is generated at the suction inlet 15.

The dust box 6 is accommodated in the body 2. The dust box 6 collects and stores therein dust and dirt sucked through the suction inlet 15. The dust box 6 is disposed in the internal space of the housing 11. The dust box 6 is disposed between the suction inlet 15 and the fan unit 5. The dust box 6 collects and stores therein dust and dirt sucked through the suction inlet 15.

As illustrated in FIG. 5, the dust box 6 includes: a body member 6A; a tray member 6B disposed in an upper end of the body member 6A; and an upper plate member 6C disposed in an upper end of the tray member 6B. An opening is provided in the upper end of the body member 6A. The tray member 6B is disposed so as to close the opening in the upper end of the body member 6A. An opening is provided in the upper end of the tray member 6B. The upper plate member 6C is disposed so as to close the opening in the upper end of the tray member 6B.

The dust box 6 internally includes a storage space S. Dust and dirt from the suction inlet 15 are stored in the storage space S inside the dust box 6. The storage space S includes: a lower storage space S1 defined between the body member 6A and the tray member 6B; and an upper storage space S2 defined between the tray member 6B and the upper plate member 6C.

The dust box 6 includes: a lower collection port 6D connected to the lower storage space S1 and configured to collect dust and dirt from the suction inlet 15; an upper collection port 6E connected to the upper storage space S2 and configured to collect dust and dirt from the suction inlet 15; and an air outlet 6F connected to the upper storage space S2 and configured to discharge air from the upper storage space S2.

The lower collection port 6D is provided in a front portion of the body member 6A. The upper collection port 6E is provided above the lower collection port 6D. The upper collection port 6E is provided in a front portion of the tray member 6B. The air outlet 6F is provided more behind than the lower collection port 6D and the upper collection port 6E. The air outlet 6F is provided in a rear portion of the tray member 6B. The lower storage space S1 is connected to the suction inlet 15 via the lower collection port 6D. The upper storage space S2 is connected to the suction inlet 15 via the upper collection port 6E. The air outlet 6F is connected to the air inlet 5D of the fan unit 5. The fan unit 5 is connected to the suction inlet 15 via the air outlet 6F and the upper storage space S2. A filter 6G that traps dust and dirt is disposed between the air outlet 6F and the upper storage space S2.

The cover plate 11C is detachably mounted on the upper housing 11A. The cover plate 11C is disposed so as to close an opening provided in the upper housing 11A. The user of the robotic dust collector 1 can take out the dust box 6 from the internal space of the housing 11 via the opening in the upper housing 11A. The user of the robotic dust collector 1 can place the dust box 6 inside the internal space of the housing 11 via the opening in the upper housing 11A.

The body 2 is movably supported by the casters 7 and the roller 8. The casters 7 and the roller 8 are individually rotatably supported by the body 2. Two such casters 7 in total are provided in a rear portion of the bottom face 2B. One of the casters 7 is provided in a left portion of the body 2. The other caster 7 is provided in a right portion of the body 2. One such roller 8 in total is provided in the front portion of the bottom face 2B.

The travel device 12 moves the body 2 in at least one of the forward and rearward directions. The travel device 12 includes wheels 9 and wheel motors 10.

The body 2 is movably supported by the wheels 9. The individual wheels 9 rotate about a rotation axis AX. The rotation axis AX extends in the left and right directions. Two such wheels 9 in total are provided. One of the wheels 9 is provided in the left portion of the body 2. The other wheel 9 is provided in the right portion of the body 2.

The wheel motors 10 generate motive power to rotate the wheels 9. The wheel motors 10 are driven by electric power supplied from the batteries BT. The wheel motors 10 are disposed in the internal space of the housing 11. Two such wheel motors 10 in total are provided. One of the wheel motors 10 generates motive power to rotate the wheel 9 provided in the left portion of the body 2. The other wheel motor 10 generates motive power to rotate the wheel 9 provided in the right portion of the body 2. The wheels 9 rotate by being driven by the wheel motors 10. When the wheels 9 rotate, the robotic dust collector 1 autonomously travels.

The wheel motors 10 are capable of changing directions of rotation of the wheels 9. When the wheels 9 rotate in a first direction, the robotic dust collector 1 moves forward. When the wheels 9 rotate in a direction opposite to the first direction, the robotic dust collector 1 moves backward. Two wheel motors 10 are capable of being driven with different amounts of driving force. The robotic dust collector 1 turns when the two wheel motors 10 are driven by different amounts of driving force.

The travel device 12 includes a suspension device supporting the wheels 9. The suspension device is coupled to the body 2. At least a part of the suspension device is disposed in the internal space of the housing 11. The wheels 9 are supported by the body 2 via the suspension device. The wheels 9 are supported by the suspension device so as to be movable upward and downward. The wheels 9 are supported by the suspension device so as to be rotatable about the rotation axis AX. The wheels 9 are supported by the suspension device in such a manner to at least partly project downward from the bottom face 2B. At least a part of each of the wheels 9 projects downward from the bottom face 2B. With the wheels 9 placed on the cleaning target floor FL, the bottom face 2B of the body 2 faces the cleaning target floor FL with a gap therebetween.

The main brush 16 is disposed in the suction inlet 15. The main brush 16 faces the cleaning target floor FL. The main brush 16 is elongated in the left and right directions. The main brush 16 rotates about a rotation axis MX. The rotation axis MX extends in the left and right directions. The main brush 16 includes: a rod member 16R extending in the left and right directions; and brushes 16B connected to the outer surface of the rod member 16R. A left end and a right end of the rod member 16R are individually rotatably supported by the body 2. The rod member 16R is supported by the body 2 in such a manner that at least parts of the brushes 16B project downward from the bottom face 2B. With the wheels 9 placed on the cleaning target floor FL, at least a part of the main brush 16 makes contact with the cleaning target floor FL. When the main brush 16 rotates, dust and dirt present on the cleaning target floor FL are gathered up and sucked in through the suction inlet 15.

The main brush motor 17 generates motive power to rotate the main brush 16. The main brush motor 17 is driven by electric power supplied from the batteries BT. The main brush motor 17 is disposed in the internal space of the housing 11. When the main brush motor 17 is driven, the main brush 16 rotates.

The guide member 14 guides dust and dirt present on the cleaning target floor FL toward the suction inlet 15. The guide member 14 is disposed on a rear end of the suction inlet 15. The guide member 14 is disposed more behind than the rotation axis MX of the main brush 16. A lower end of the guide member 14 makes contact with the cleaning target floor FL. The guide member 14 traps at least a part of dust and dirt gathered up by the main brush 16. The guide member 14 prevents dust and dirt gathered up by the main brush 16 from moving to behind the suction inlet 15. At least a part of dust and dirt gathered up by the main brush 16 is trapped by the guide member 14 and sucked in through the suction inlet 15.

The side brushes 18 are disposed in the front portion of the bottom face 2B. The side brushes 18 face the cleaning target floor FL. At least a part of the side brush 18 is disposed ahead of the body 2. Two such side brushes 18 in total are provided. One of the side brushes 18 is provided to the left of the suction inlet 15. The other side brush 18 is provided to the right of the suction inlet 15. The side brush 18 includes a disc member 18D and a plurality of brushes 18B radially connected with the disc member 18D. The disc member 18D is rotatably supported by the body 2. The disc member 18D is supported by the body 2 in such a manner that at least a part of the brushes 18B projects outside of the side face 2C. With the wheels 9 placed on the cleaning target floor FL, at least a part of the side brushes 18 makes contact with the cleaning target floor FL.

The side brush motors 19 generate motive power to rotate the side brushes 18. The side brush motors 19 are driven by electric power supplied from the batteries BT. The side brush motors 19 are disposed in the internal space of the housing 11. When the side brush motors 19 are driven, the side brushes 18 rotate. When the side brushes 18 rotate, dust and dirt present on the cleaning target floor FL in an area surrounding the body 2 move to the suction inlet 15.

The handle 20 is provided in a front portion of the upper housing 11A. One end and the other end of the handle 20 are turnably coupled to the upper housing 11A. The user of the robotic dust collector 1 can hold up the robotic dust collector 1 by gripping the handle 20. The user of the robotic dust collector 1 can carry the robotic dust collector 1.

The interface device 50 is disposed in a rear portion of the cover plate 11C. The interface device 50 includes a plurality of operation parts and a plurality of indicators that are to be operated by the user of the robotic dust collector 1. A power button 50A is exemplified as one of the operation parts of the interface device 50. Remaining power indicators 50B for the batteries BT are exemplified as the indicator of the interface device 50. A light emitting unit 51 including a light emitting diode is provided in the front portion of the upper housing 11A.

The optical sensor 40 detects an object present in at least a part of an area surrounding the robotic dust collector 1. Examples of the object include an obstacle. The optical sensor 40 is disposed in a front portion of the body 2. One such optical sensor 40 in total is provided. The optical sensor 40 detects an object present ahead of the robotic dust collector 1 in a non-contact manner. In the present embodiment, the optical sensor 40 includes a camera that detects an object by acquiring image data of the object.

The optical sensor 40 is disposed in the internal space of the housing 11. A body opening 71 is provided through at least a part of the body 2. A bumper opening 72 is provided through at least a part of the bumper 3. The optical sensor 40 detects, through the body opening 71 and the bumper opening 72, an object present ahead of the robotic dust collector 1.

The object sensor 41 detects an object present in at least a part of an area surrounding the robotic dust collector 1. The object sensors 41 are disposed in the front portion of the body 2. A plurality of such object sensors 41 in total are provided at intervals. The object sensor 41 detects an object in at least a part of an area surrounding the robotic dust collector 1 in a non-contact manner. In the present embodiment, the object sensor 41 detects an object by emitting an energy wave. Any of the following exemplifies the object sensor 41: a laser sensor (or light detection and ranging (LIDAR) sensor) that detects an object by emitting laser light; a radio detection and ranging (RADAR) sensor that detects an object by emitting an electric wave; and an ultrasonic sensor that detects an object by emitting ultrasound.

Upon determining, based on either or both of the data detected by the optical sensor 40 and the data detected by the object sensors 41, that an object is present at least in a part of the area surrounding the robotic dust collector 1, the robotic dust collector 1 travels while avoiding making contact with the object. The robotic dust collector 1, for example, changes the traveling direction thereof so as to avoid making contact with the object. The robotic dust collector 1 may stop traveling so as to avoid making contact with the object. The robotic dust collector 1 may make contact with the object. The robotic dust collector 1 may make contact with the object and then change the traveling direction thereof or stop traveling.

The fall prevention sensors 42 detect the presence of the cleaning target floor FL. The fall prevention sensors 42 are provided on the bottom face 2B. As illustrated in FIG. 3, the fall prevention sensors 42 are provided at intervals in the peripheral portion of the bottom face 2B. The fall prevention sensors 42 include: a fall prevention sensor 42F provided in the front portion of the bottom face 2B; a fall prevention sensor 42B provided in a rear portion of the bottom face 2B; a fall prevention sensor 42L provided in a left portion of the bottom face 2B; and a fall prevention sensor 42R provided in a right portion of the bottom face 2B.

The fall prevention sensors 42 detect, in a non-contact manner, whether the cleaning target floor FL is present on corresponding locations facing the bottom face 2B. The fall prevention sensors 42 detect the corresponding distances between the bottom face 2B and the cleaning target floor FL. The fall prevention sensor 42 detects the corresponding distance with the cleaning target floor FL by emitting an energy wave downward. Any of the following exemplifies the fall prevention sensor 42: a LIDAR sensor that detects an object by emitting laser light; and a RADAR sensor that detects an object by emitting an electric wave. When the bottom face 2B is away from the cleaning target floor FL by a predetermined distance or more, the robotic dust collector 1 determines, based on data detected by the corresponding fall prevention sensor 42, that the cleaning target floor FL is not present at a corresponding location facing the bottom face 2B. Upon determining that the cleaning target floor FL is not present at the corresponding location facing the bottom face 2B, the robotic dust collector 1 stops traveling. For example, when the boundary of the cleaning target floor FL is connected to a descending step, the fall prevention sensors 42 detect a step. Upon determining a step to be present based on data detected by the fall prevention sensors 42, the robotic dust collector 1 stops traveling. This prevents the robotic dust collector 1 from falling down the step.

The member sensors 43 detect a partitioning member provided in the cleaning target floor FL. The member sensors 43 are provided on the bottom face 2B. As illustrated in FIG. 3, a plurality of such member sensors 43 in total are provided at intervals in the front portion of the bottom face 2B.

The member sensors 43 are disposed to the left and to the right of the roller 8. The two member sensors 43 are disposed side by side in the left and right directions. The left member sensor 43 is disposed outside the left side brush 18 in a radial direction of the rotation axis of the left side brush 18. The left member sensor 43 is disposed between the left side brush 18 and the roller 8 in the left and right directions. The right member sensor 43 is disposed outside the right side brush 18 in a radial direction of the rotation axis of the right side brush 18. The right member sensor 43 is disposed between the right side brush 18 and the roller 8 in the left and right directions.

The partitioning member is placed at any desired position on the cleaning target floor FL by the user of the robotic dust collector 1. A magnetic tape containing a magnetic material is exemplified as the partitioning member. A magnetic sensor capable of detecting a magnetic tape is exemplified as the member sensor 43. A cleaning target area is defined by the partitioning member. Based on data detected by the member sensors 43, the robotic dust collector 1 travels without going beyond the partitioning member. This prevents the robotic dust collector 1 from moving out of the cleaning target area, thus enabling the robotic dust collector 1 to clean the cleaning target area.

The partitioning member may be a reflective tape containing a reflective material. The member sensor 43 may be an infrared sensor that detects a reflective tape.

Coupling Mechanism

Figure 6:
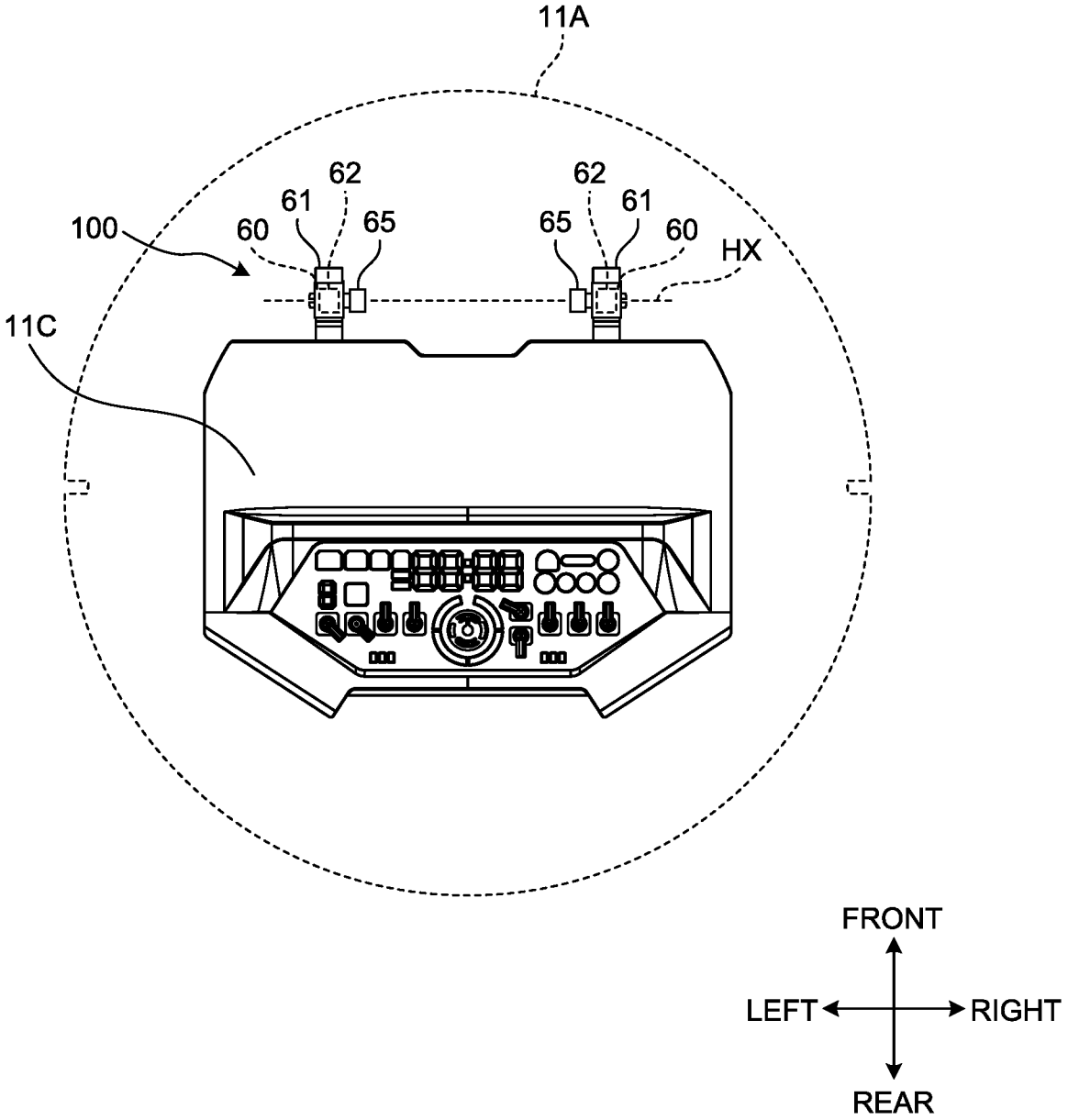
FIG. 6 is a schematic top view of a coupling mechanism according to the first embodiment.
Figure 7:
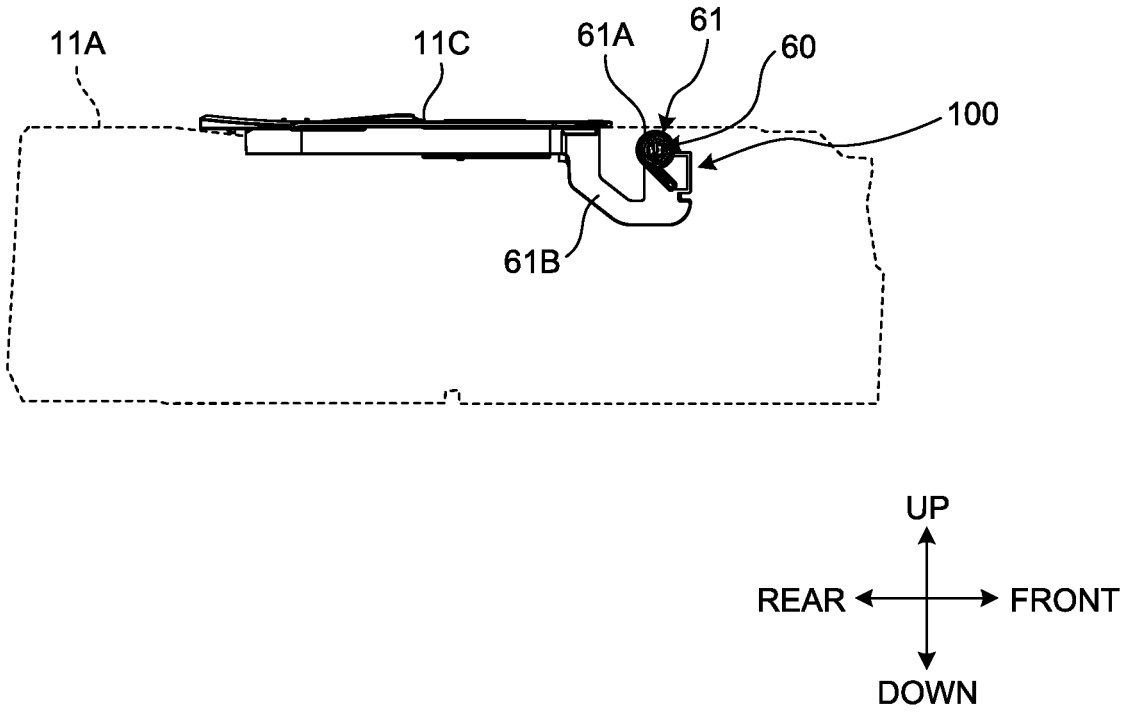
FIG. 7 is a schematic side view of the coupling mechanism according to the first embodiment.
Figure 8:
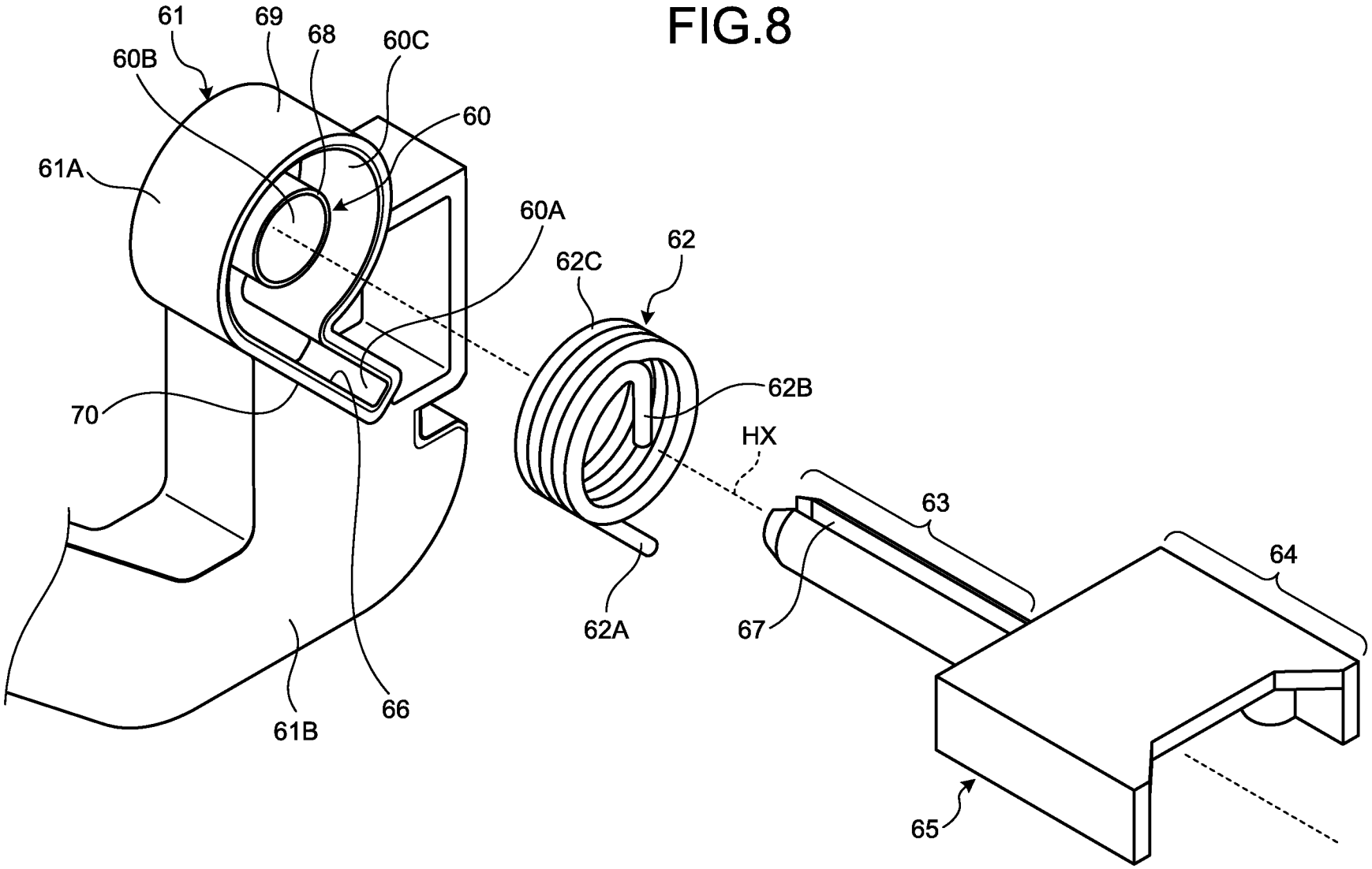
FIG. 8 is an exploded perspective view of the coupling mechanism according to the first embodiment.
Figure 9:
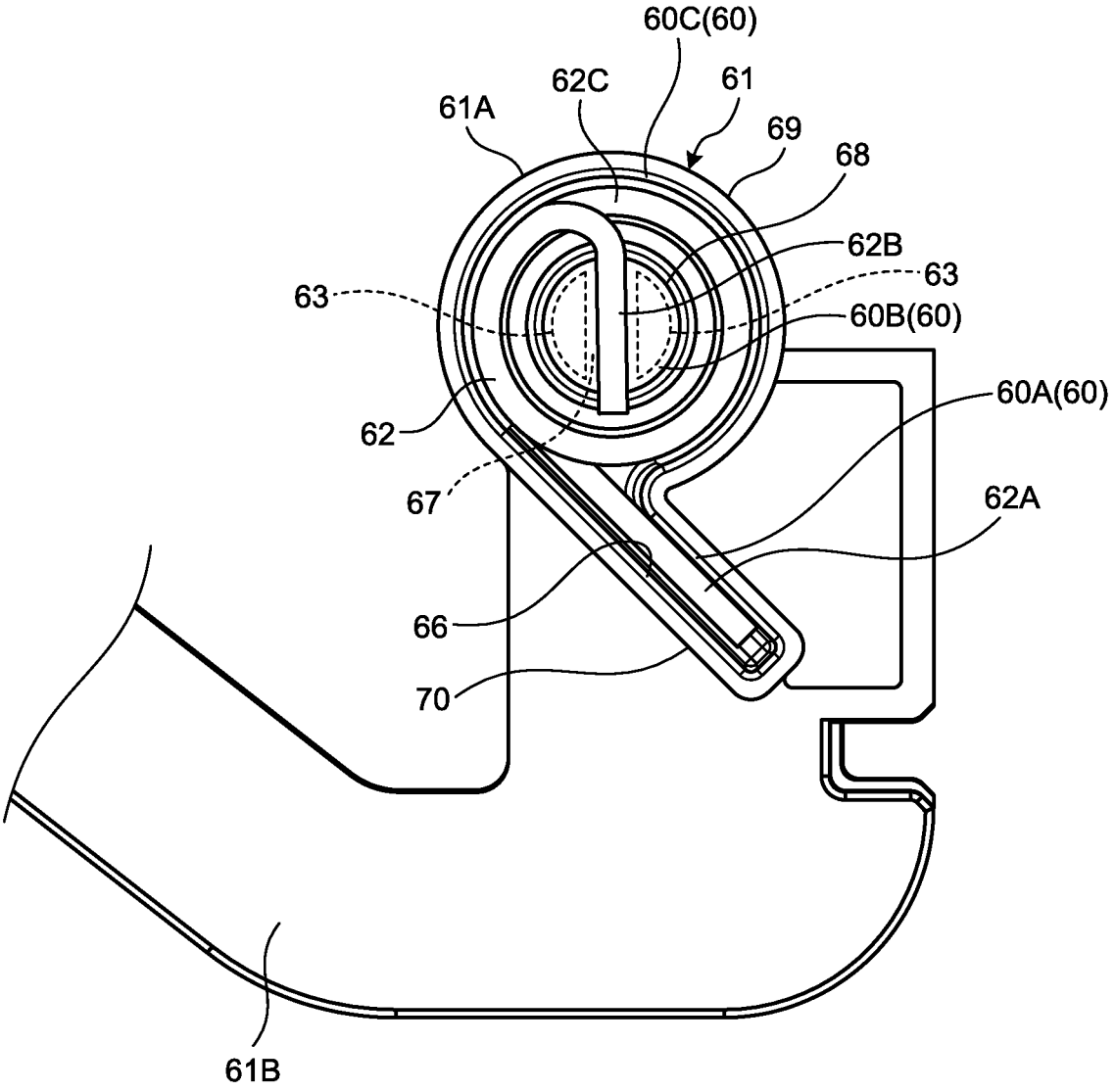
FIG. 9 is a side view of the coupling mechanism according to the first embodiment.
Figure 10:
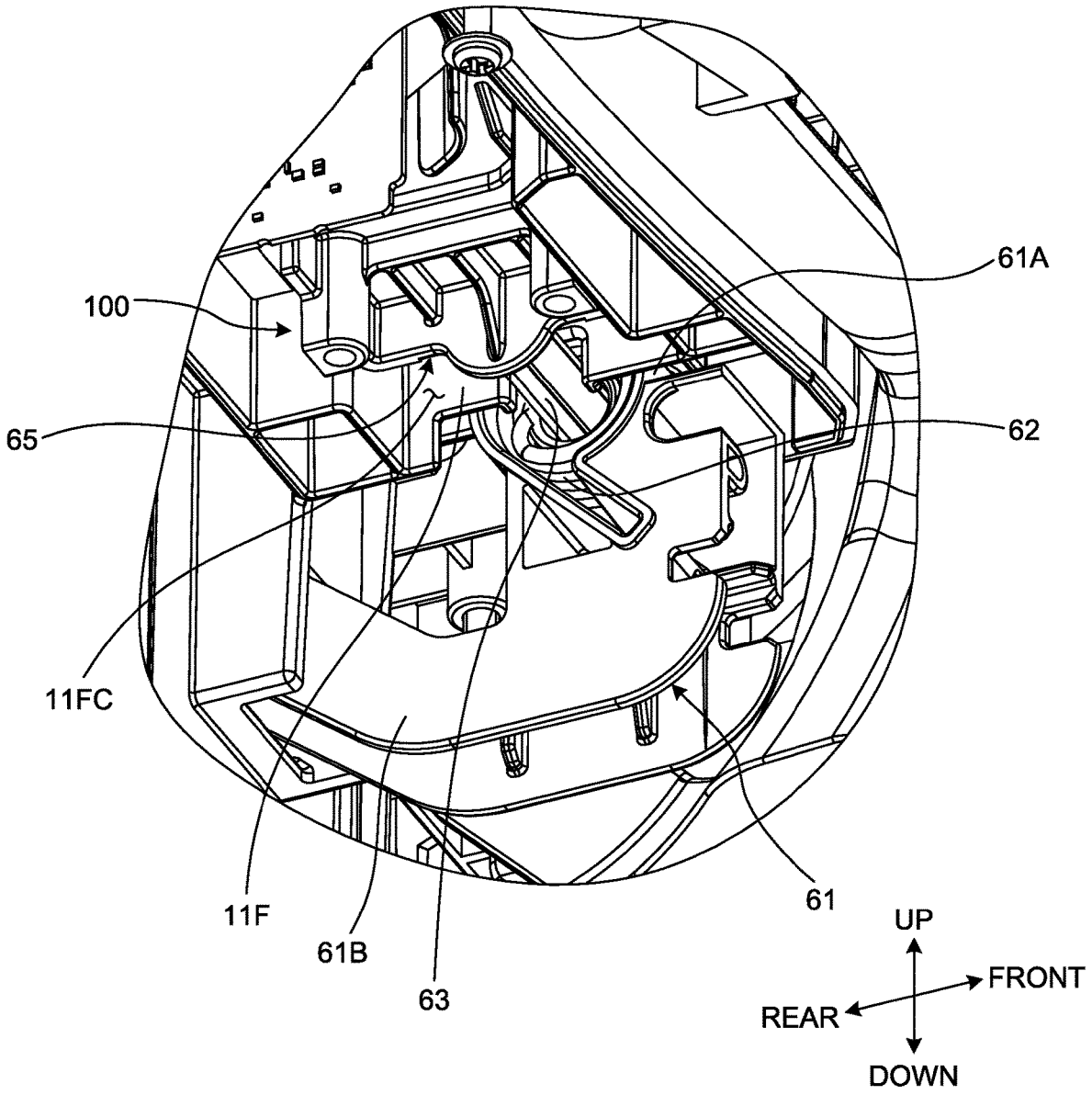
FIG. 10 is a perspective view of the coupling mechanism according to the first embodiment.

FIG. 6 is a schematic top view of a coupling mechanism 100 according to the present embodiment. FIG. 7 is a schematic side view of the coupling mechanism 100 according to the present embodiment. FIG. 8 is an exploded perspective view of the coupling mechanism 100 according to the present embodiment. FIG. 9 is a side view of the coupling mechanism 100 according to the present embodiment. FIG. 10 is a perspective view of the coupling mechanism 100 according to the present embodiment.

The coupling mechanism 100 couples together the upper housing 11A and the cover plate 11C. The coupling mechanism 100 includes a hinge part by which the cover plate 11C is supported so as to be rotatable about a rotation axis HX. The rotation axis HX extends in the left and right directions.

The coupling mechanism 100 includes: first hinge members 61 connected to the cover plate 11C and having respective insertion spaces 60; elastic members 62 disposed in the respective insertion spaces 60; and second hinge members 65 by which the respective first hinge members 61 are supported so as to be rotatable about the rotation axis HX.

The first hinge member 61 includes: an insertion part 61A in which the insertion space 60 is provided; and a lever part 61B coupling together the insertion part 61A and the cover plate 11C.

The insertion part 61A includes: an outer cylinder part 69; an inner cylinder part 68 disposed inside the outer cylinder part 69; and a projection 70 projecting outward from the outer cylinder part 69.

The elastic member 62 is disposed in the insertion space 60. The entirety of the elastic member 62 is disposed in the insertion space 60. The elastic member 62 provides elasticity for opening the cover plate 11C in a state of being disposed in the insertion space 60. Examples of the elastic member 62 include a torsion spring. The elastic member 62 includes: a coil part 62C; an outer projection 62A projecting outward from the coil part 62C; and an inner projection 62B projecting inward from the coil part 62C. The outside projection 62A is linear. The inside projection 62B is linear.

The insertion space 60 includes: a cylindrical space 60C in which the coil part 62C is disposed; a projection space 60A in which the outer projection 62A is disposed; and an inside space 60B. The cylindrical space 60C is formed between the outer cylinder part 69 and the inner cylinder part 68. The projection space 60A is formed in the projection 70. The inside space 60B is formed inside the inner cylinder part 68.

With the coil part 62C inserted in the cylindrical space 60C and with the outer projection 62A inserted in the projection space 60A, at least a part of a surface of the outer projection 62A makes contact with an inner surface 66 of the projection space 60A. When at least a part of the surface of the outer projection 62A makes contact with the inner surface 66 of the projection space 60A, the relative position of the first hinge member 61 and at least a part of the elastic member 62 is fixed in a direction of rotation about the rotation axis HX. In the present embodiment, the inner surface 66 of the projection space 60A functions as a first positioning part that fixes the relative position of the first hinge member 61 and at least a part of the elastic member 62 in a direction of rotation about the rotation axis HX.

With the coil part 62C inserted in the cylindrical space 60C and with the outer projection 62A inserted in the projection space 60A, at least a part or parts of a surface of the coil part 62C makes or make contact with either or both of the outer circumferential surface of the inner cylinder part 68 and the inner circumferential surface of the outer cylinder part 69. When at least a part or parts of the surface of the coil part 62C makes or make contact with either or both of the outer circumferential surface inner cylinder part 68 and the inner circumferential surface of the outer cylinder part 69, the relative positions of the first hinge member 61 and at least a part of the elastic member 62 are fixed in radial directions of the rotation axis HX. In the present embodiment, either or both of the inner cylinder part 68 and the outer cylinder part 69 functions or function as a third positioning part that fixes the relative positions of the first hinge member 61 and at least a part of the elastic member 62 in radial directions of the rotation axis HX.

With the coil part 62C inserted in the cylindrical space 60C and with the outer projection 62A inserted in the projection space 60A, at least a part of the outer surface of the inner projection 62B faces the inside space 60B. That is, the inside space 60B and at least a part of the inner projection 62B overlap each other in a section perpendicular to the rotation axis HX.

At least a part of the second hinge member 65 is fixed to the upper housing 11A. The second hinge member 65 supports the first hinge member 61 in a manner that allows the first hinge member 61 to rotate, in a state of supporting the elastic member 62. The first hinge member 61 is supported by the second hinge member 65 so as to be rotatable about the rotation axis HX.

The second hinge member 65 includes: a shaft part 63 inserted into the insertion space 60 and supporting the elastic member 62; and a fixture part 64 fixed to at least a part of the upper housing 11A.

The shaft part 63 is inserted in the inside space 60B. The shaft part 63 includes a slit 67 in which at least a part of the elastic member 62 is disposed. The slit 67 is formed in a direction parallel to the rotation axis HX. The shaft part 63 is inserted in the inside space 60B in such a manner that the inner projection 62B is disposed in the slit 67. With the shaft part 63 inserted in the inside space 60B in such a manner that the inner projection 62B is disposed in the slit 67 with the elastic member 62 inserted in the insertion space 60, at least a part of a surface of the inner projection 62B makes contact with an inner surface of the slit 67. With at least a part of the surface of the inner projection 62B making in contact with the inner surface of the slit 67, the relative position of the second hinge member 65 and at least a part of the elastic member 62 is fixed in a direction of rotation about the rotation axis HX. In the present embodiment, the slit 67 provided in the shaft part 63 functions as a second positioning part that fixes the relative position of the second hinge member 65 and at least a part of the elastic member 62 in a direction of rotation about the rotation axis HX.

Coupling between Upper Housing and Cover Plate Next, work of coupling between the upper housing 11A and the cover plate 11C is described. For example, as illustrated in FIG. 7, the elastic member 62 is inserted in the insertion space 60 in such a manner that the coil part 62C is disposed in the cylindrical space 60C and that the outer projection 62A is disposed in the projection space 60A. With the outer projection 62A disposed in the projection space 60A with the coil part 62C disposed in the cylindrical space 60C, the inner projection 62B faces the inside space 60B. The dimension of the insertion part 61A is larger than the dimension of elastic member 62 in a direction parallel to the rotation axis HX. The entirety of the elastic member 62 is disposed in the insertion space 60 without any part of the elastic member 62 sticking out from the insertion space 60. Increase in size of the coupling mechanism 100 is prevented because the elastic member 62 does not stick out from the insertion space 60.

After the elastic member 62 is disposed in the insertion space 60, the shaft part 63 of the second hinge member 65 is inserted in the inside space 60B of the insertion space 60. The inner projection 62B is disposed at an entrance of the inside space 60B. The shaft part 63 is inserted in the inside space 60B in such a manner that the inner projection 62B is disposed in the slit 67. The shaft part 63 is inserted in the inside space 60B with the inner projection 62B disposed in the slit 67, whereby the first hinge member 61 and the second hinge member 65 are coupled together.

Upon completion of insertion of the shaft part 63 in the inside space 60B, the fixture part 64 of the second hinge member 65 is disposed outside the insertion space 60. The fixture part 64 is fixed to at least a part of the upper housing 11A. Thus, the upper housing 11A and the cover plate 11C are coupled together. The cover plate 11C is supported by the upper housing 11A so as to be rotatable about the rotation axis HX.

For example, when using a cable for connecting the battery mounting unit 4 provided in the upper housing 11A to the interface device 50 provided in the cover plate 11C, a part of the cable is disposed near the coupling mechanism 100. In the present embodiment, the entirety of the elastic member 62 is disposed in the insertion space 60. Thus, the cable is not caught by the elastic member 62 and is disposed with excellent work efficiency. The cable is disposed without making contact with the elastic member 62. The interface device 50 is driven by electric power supplied via the cables from the batteries BT.

The first hinge member 61 has the inner surface 66 that functions as the first positioning part that fixes the relative position of the first hinge member 61 and at least a part of the elastic member 62 in a direction of rotation about the rotation axis HX. The second hinge member 65 has the slit 67 that functions as the second positioning part that fixes the relative position of the second hinge member 65 and at least a part of the elastic member 62 in a direction of rotation about the rotation axis HX. The first hinge member 61 has the inner cylinder part 68 and the outer cylinder part 69 both or either of which function or functions as a third positioning part that fixes the relative positions of the first hinge member 61 and at least a part of the elastic member 62 in radial directions of the rotation axis HX. Thus, the elastic member 62 is prevented from spinning free inside the insertion space 60 and can provide sufficient elasticity.

Operation

Next, operation of the robotic dust collector 1 is described. With the wheels 9 placed on the cleaning target floor FL, the main brush 16 and the side brushes 18 make contact with the cleaning target floor FL. Electric power output from the batteries BT is supplied to the wheel motors 10, the suction motor 5C, the main brush motor 17, and the side brush motors 19.

When the wheels 9 rotate by having electric power supplied to the wheel motors 10 from the batteries BT with the wheels 9 making contact with the cleaning target floor FL, the robotic dust collector 1 autonomously travels on the cleaning target floor FL.

When the suction fan 5B rotates with electric power supplied to the suction motor 5C from the batteries BT, an airstream is generated from the air inlet 5D toward the air outlet 5E. The air inlet 5D is connected to the suction inlet 15 via the upper storage space S2 of the dust box 6. Thus, when the suction fan 5B rotates, an airstream is generated from the suction inlet 15 toward the air outlet 5E via the upper storage space S2. As a result, suction power for sucking dust and dirt is generated at the suction inlet 15.

When the main brush 16 rotates with electric power supplied to the main brush motor 17 from the batteries BT, dust and dirt on the cleaning target floor FL is gathered up by the main brush 16. The suction inlet 15 sucks at least a part of dust and dirt gathered up by the main brush 16.

When the side brushes 18 rotate with electric power supplied to the side brush motors 19 from the batteries BT, the side brushes 18 causes dust and dirt present on the cleaning target floor FL in an area surrounding the body 2 to move to the suction inlet 15. The suction inlet 15 sucks at least a part of dust and dirt caused by the side brushes 18 to move to the suction inlet 15 and gathered up by the main brush 16.

Relatively small or relatively light particles of dirt and dust present on the cleaning target floor FL are sent into the upper storage space S2 via the upper collection port 6E after being sucked through the suction inlet 15. The dust and dirt are stored in the upper storage space S2. The filter 6G is provided between the upper storage space S2 and the air outlet 6F. Thus, dust and dirt sent into the upper storage space S2 via the upper collection port 6E are trapped by the filter 6G and stay in the upper storage space S2. Air sucked through the suction inlet 15 is sent to the fan unit 5 via the air outlet 6F after passing the filter 6G. Air sent to the fan unit 5 is discharged from the air outlet 5E.

Relatively large or relatively heavy particles of dirt and dust present on the cleaning target floor FL are gathered up by the main brush 16 and then sent into the lower storage space S1 via the lower collection port 6D. The dust and dirt are stored in the lower storage space S1.

When the dust box 6 is filled with dust and dirt, the user of the robotic dust collector 1 operates a lock mechanism by which the cover plate 11C and the upper housing 11A have been locked together, thereby unlocking the cover plate 11C and the upper housing 11A from each other. The elastic member 62 provides elasticity so as to open the cover plate 11C, whereby the user of the robotic dust collector 1 can easily open the cover plate 11C simply by unlocking the lock mechanism. After the opening in the upper housing 11A is opened by having the cover plate 11C opened, the user of the robotic dust collector 1 can take out the dust box 6 from the internal space of the housing 11 via the opening in the upper housing 11A. After cleaning the dust box 6, the user of the robotic dust collector 1 can place the dust box 6 inside the internal space of the housing 11 via the opening in the upper housing 11A. After placing the dust box 6 inside the internal space of the housing 11, the user of the robotic dust collector 1 operates the cover plate 11C to close the opening of upper housing 11A.

Effects

As described above, according to the present embodiment, the coupling mechanism 100 includes: the first hinge members 61 each connected to the cover plate 11C that can open and close the opening in the upper housing 11A and each having the insertion space 60; the elastic members 62 each disposed in the corresponding insertion space 60; and the second hinge members 65. The second hinge member 65 includes the shaft part 63 that is inserted in the corresponding insertion space 60 and supports the elastic member 62. The second hinge member 65 further includes the fixture part 64 fixed to at least a part of the upper housing 11A. The first hinge member 61 is supported by the second hinge member 65 so as to be rotatable about the rotation axis HX. The entirety of the elastic member 62 is disposed in the insertion space 60 of the first hinge member 61, and the elastic member 62 is supported by the second hinge member 65. The present embodiment thus prevents the coupling mechanism 100 from being larger in size. Furthermore, the present embodiment allows for improved assembly work efficiency when the upper housing 11A and the cover plate 11C is coupled together.

The first hinge member 61 has the inner surface 66 that functions as the first positioning part that fixes the relative position of the first hinge member 61 and at least a part of the elastic member 62 in a direction of rotation about the rotation axis HX. The second hinge member 65 has the slit 67 that functions as the second positioning part that fixes the relative position of the second hinge member 65 and at least a part of the elastic member 62 in a direction of rotation about the rotation axis HX. The first hinge member 61 has the inner cylinder part 68 and the outer cylinder part 69 both or either of which function or functions as a third positioning part that fixes the relative positions of the first hinge member 61 and at least a part of the elastic member 62 in radial directions of the rotation axis HX. Thus, the elastic member 62 is prevented from spinning free inside the insertion space 60 and can provide sufficient elasticity.

Second Embodiment

A second embodiment is described. In the following description, the same constituent elements as those in the above embodiment are assigned the same reference signs, and description thereof is omitted.

Figure 11:
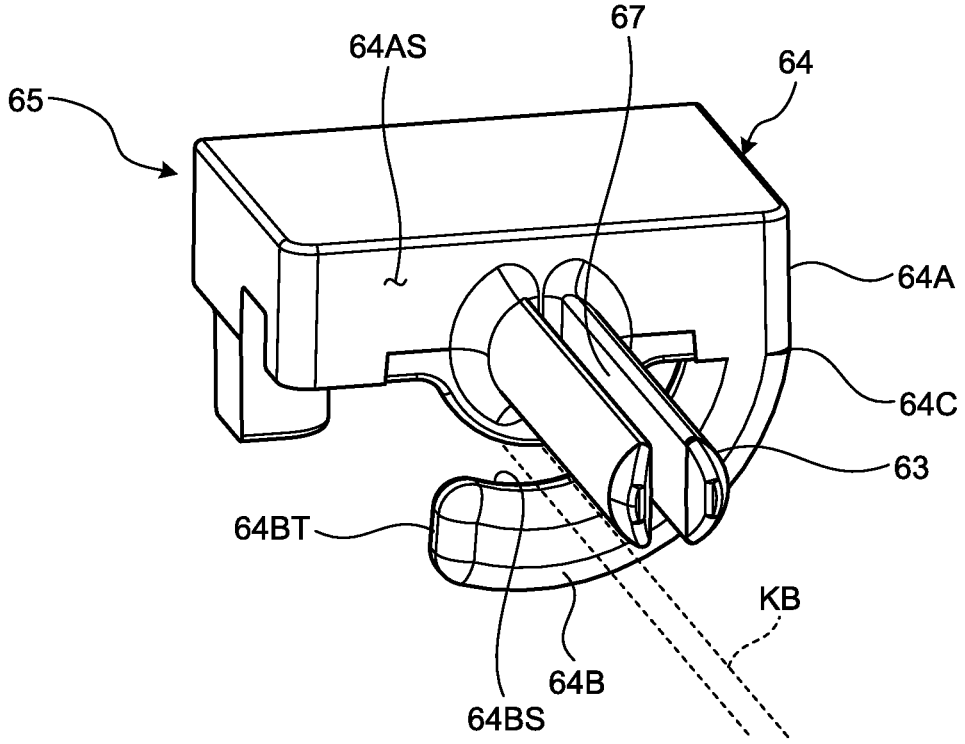
FIG. 11 is a perspective view of a second hinge member according to a second embodiment.
Figure 12:
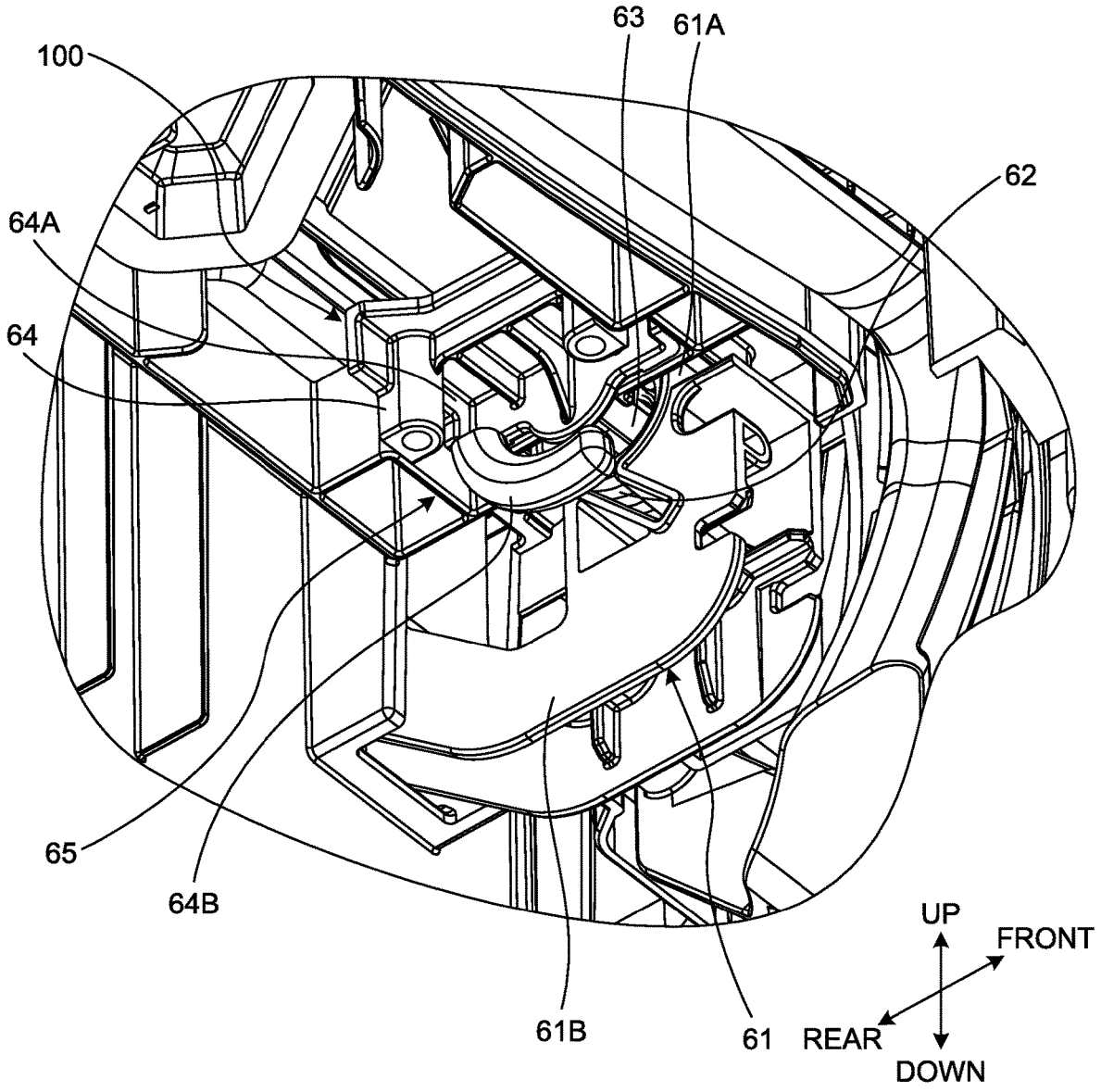
FIG. 12 is a perspective view of a coupling mechanism according to the second embodiment.

FIG. 11 is a perspective view of a second hinge member 65 according to the present embodiment. FIG. 12 is a perspective view of a coupling mechanism 100 according to the present embodiment. As in the above-described embodiment, the second hinge member 65 includes: the shaft part 63 inserted into the insertion space 60 and supporting the elastic member 62; and the fixture part 64 fixed to at least a part of the upper housing 11A. The shaft part 63 includes the slit 67.

In the present embodiment, the fixture part 64 includes: a base 64A connected to the shaft part 63; an arm part 64B facing the base 64A with a gap therebetween; and a connection part 64C connecting one end of the arm part 64B and the base 64A with each other.

The base 64A is a block-like member. The shaft part 63 is connected to a side face 64AS of the base 64A.

The arm part 64B is an arc-like member. The arm part 64B is disposed so as to face a lower face of the base 64A with a gap therebetween. The one end of the arm part 64B is connected to the lower face of the base 64A via the connection part 64C. The other end 64BT of the arm part 64B is distanced from the base 64A. The arm part 64B has a top face 64BS facing the lower face of the base 64A with a gap therebetween.

The arm part 64B is capable of holding a cable KB. The cable KB is disposed in a space between the lower face of the base 64A and the top face 64BS of the arm part 64B. The cable KB is inserted in the space between the base 64A and the arm part 64B via an opening between the other end 64BT of the arm part 64B and the base 64A. The top face 64BS of the arm part 64B is capable of holding the cable KB. The arm part 64B can function as a cable holder that holds the cable KB.

The cable KB is connected to the cover plate 11C. The cable KB connects, for example the battery mounting units 4 and the interface device 50 provided in the cover plate 11C with each other. Electric power from the batteries BT is supplied to the interface device 50 via the cables KB.

As described above, according to the present embodiment, the arm part 64B that functions as a cable holder is provided in the fixture part 64. This improves the work efficiency of disposing the cable KB.

Third Embodiment

A third embodiment is described. In the following description, the same constituent elements as those in the above-described embodiment are assigned the same reference signs, and description thereof is omitted.

Figure 13:
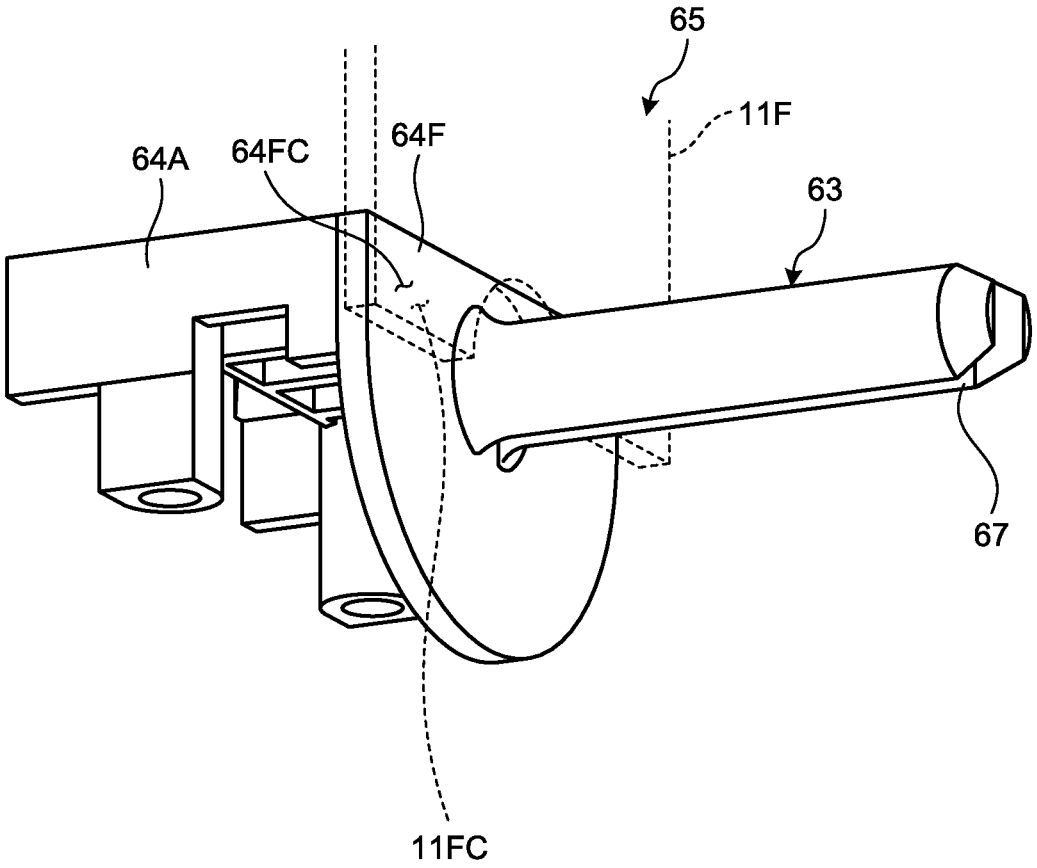
FIG. 13 is a perspective view of a second hinge member according to a third embodiment.

FIG. 13 is a perspective view of a second hinge member 65 according to the present embodiment. As in the above-described embodiments, the second hinge member 65 includes: the shaft part 63; and the fixture part 64 fixed to at least a part of the upper housing 11A. The shaft part 63 includes the slit 67.

In the present embodiment, the fixture part 64 includes: a flange part 64F connected to the shaft part 63; and the base 64A supporting the flange part 64F. The flange part 64F has a first sealing surface 64FC disposed around the shaft part 63. The first sealing surface 64FC is a plane perpendicular to the rotation axis HX.

With the cover plate 11C closing the opening in the upper housing 11A, the first sealing surface 64FC makes contact with a second sealing surface 11FC of a sealing plate 11F provided to the upper housing 11A. An example of the sealing plate 11F is illustrated in FIG. 10.

With the cover plate 11C closing the opening in the upper housing 11A, the first sealing surface 64FC makes contact with the second sealing surface 11FC. As a result, even when a gap is formed between the upper housing 11A and the cover plate 11C, particles of dust and dirt and foreign objects in a space outside the housing 11 can be prevented from entering the internal space of the housing 11 from between the first hinge member 61 and the second hinge member 65.

Other Embodiments

In the above-described embodiments, the shaft part 63 includes the slit 67. The shaft part 63 may be provided without the slit 67. When at least a part of the shaft part 63 makes contact with the elastic member 62 disposed in the insertion space 60, the relative position of the second hinge member 65 and at least a part of the elastic member 62 are fixed in a direction of rotation about the rotation axis HX.

An aspect of the present disclosure can prevent a hinge part from being large in size and improve assembly work efficiency.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A robotic dust collector comprising:

a cover plate that closes an opening of a housing;

a first hinge member connected to the cover plate and having an insertion space;

an elastic member disposed in the insertion space; and a second hinge member that includes a shaft part and a fixture part and supports the first hinge member in a manner that allows the first hinge member to rotate about a rotation axis, the shaft part being inserted in the insertion space and supporting the elastic member, the fixture part being fixed to at least a part of the housing, wherein the first hinge member includes:

a first positioning part that fixes a relative position of the first hinge member and at least a part of the elastic member in a direction of rotation about the rotation axis; and a third positioning part that fixes relative positions of the first hinge member and at least a part of the elastic member in radial directions of the rotation axis, the elastic member includes:

a coil part;

an outer projection projecting outward from the coil part; and an inner projection projecting inward from the coil part, the first hinge member includes:

an insertion part in which the insertion space is provided; and a lever part coupling together the insertion part and the cover plate, the insertion space includes:

an outer cylinder part;

an inner cylinder part disposed inside the outer cylinder part; and a projection projecting outward from the outer cylinder part in a radial direction of the rotation axis, the projection includes a projection space in which the outer projection is disposed, the first positioning part includes an inner surface of the projection space, and the third positioning part includes at least one of the inner cylinder part and the outer cylinder part.

2. The robotic dust collector according to claim 1, wherein the second hinge member includes a second positioning part that fixes a relative position of the second hinge member and at least a part of the elastic member in the direction of rotation.

3. The robotic dust collector according to claim 2, wherein the shaft part includes a slit in which at least a part of the elastic member is disposed, and the second positioning part includes the slit.

4. The robotic dust collector according to claim 1, wherein
the fixture part includes a flange part connected to the shaft part and a base supporting the flange part,
the flange part includes a first sealing surface disposed around the shaft part, and
the first sealing surface makes contact with a second sealing surface provided to the housing.

5. The robotic dust collector according to claim 1, wherein
the second hinge member includes a second positioning part that fixes a relative position of the second hinge member and at least a part of the elastic member in the direction of rotation,
the insertion space includes:
a cylindrical space in which the coil part is disposed;
a projection space in which the outer projection is disposed; and
an inside space, and
the second positioning part is disposed in the shaft part inserted in the insertion space and includes a slit in which the inner projection is disposed.

6. The robotic dust collector according to claim 1, wherein
the fixture part includes a flange part connected to the shaft part and a base supporting the flange part,
the flange part includes a first sealing surface disposed around the shaft part, and
the first sealing surface makes contact with a second sealing surface provided to the housing.

7. The robotic dust collector according to claim 1, wherein
the second hinge member includes a second positioning part that fixes a relative position of the second hinge member and at least a part of the elastic member in the direction of rotation,
the fixture part includes a flange part connected to the shaft part and a base supporting the flange part,
the flange part includes a first sealing surface disposed around the shaft part, and
the first sealing surface makes contact with a second sealing surface provided to the housing.

8. A robotic dust collector comprising:
a cover plate that closes an opening of a housing;
a first hinge member connected to the cover plate and having an insertion space;
an elastic member disposed in the insertion space; and
a second hinge member that includes a shaft part and a fixture part and supports the first hinge member in a manner that allows the first hinge member to rotate about a rotation axis, the shaft part being inserted in the insertion space and supporting the elastic member, the fixture part being fixed to at least a part of the housing, wherein the fixture part includes:
a base connected to the shaft part;
an arm part facing the base with a gap therebetween; and
a connection part connecting one end of the arm part and the base with each other.

9. The robotic dust collector according to claim 8, wherein
the first hinge member includes a first positioning part that fixes a relative position of the first hinge member and at least a part of the elastic member in a direction of rotation about the rotation axis.

10. The robotic dust collector according to claim 9, wherein the first hinge member includes a third positioning part that fixes relative positions of the first hinge member and at least a part of the elastic member in radial directions of the rotation axis.

11. The robotic dust collector according to claim 8, wherein a cable that is connected to the cover plate is disposed between the base and the arm part.

12. The robotic dust collector according to claim 8, wherein the elastic member includes:
a coil part;
an outer projection projecting outward from the coil part; and
an inner projection projecting inward from the coil part.

13. The robotic dust collector according to claim 8, wherein
the second hinge member includes a second positioning part that fixes a relative position of the second hinge member and at least a part of the elastic member in the direction of rotation,
the elastic member includes:
a coil part;
an outer projection projecting outward from the coil part; and
an inner projection projecting inward from the coil part,
the insertion space includes:
a cylindrical space in which the coil part is disposed;
a projection space in which the outer projection is disposed; and
an inside space, and
the second positioning part is disposed in the shaft part inserted in the insertion space and includes a slit in which the inner projection is disposed.

14. The robotic dust collector according to claim 8, wherein
the first hinge member includes:
a first positioning part that fixes a relative position of the first hinge member and at least a part of the elastic member in a direction of rotation about the rotation axis; and
a third positioning part that fixes relative positions of the first hinge member and at least a part of the elastic member in radial directions of the rotation axis,
the second hinge member includes a second positioning part that fixes a relative position of the second hinge member and at least a part of the elastic member in the direction of rotation,
the shaft part includes a slit in which at least a part of the elastic member is disposed, and
the second positioning part includes the slit.

15. The robotic dust collector according to claim 8, wherein
the second hinge member includes a second positioning part that fixes a relative position of the second hinge member and at least a part of the elastic member in the direction of rotation.

16. The robotic dust collector according to claim 8, wherein
the first hinge member includes a first positioning part that fixes a relative position of the first hinge member and at least a part of the elastic member in a direction of rotation about the rotation axis,
the second hinge member includes a second positioning part that fixes a relative position of the second hinge member and at least a part of the elastic member in the direction of rotation,
and
a cable that is connected to the cover plate is disposed between the base and the arm part.

17. A robotic dust collector comprising:
a cover plate that closes an opening of a housing;
a first hinge member connected to the cover plate and having an insertion space;
an elastic member disposed in the insertion space; and a second hinge member that includes a shaft part and a fixture part and supports the first hinge member in a manner that allows the first hinge member to rotate about a rotation axis, the shaft part being inserted in the insertion space and supporting the elastic member, the fixture part being fixed to at least a part of the housing, wherein the first hinge member includes:

a first positioning part that fixes a relative position of the first hinge member and at least a part of the elastic member in a direction of rotation about the rotation axis; and a third positioning part that fixes relative positions of the first hinge member and at least a part of the elastic member in radial directions of the rotation axis, the second hinge member includes a second positioning part that fixes a relative position of the second hinge member and at least a part of the elastic member in the direction of rotation, the elastic member includes:

a coil part;

an outer projection projecting outward from the coil part; and an inner projection projecting inward from the coil part, the first hinge member includes:

an insertion part in which the insertion space is provided; and a lever part coupling together the insertion part and the cover plate, the insertion space includes:

an outer cylinder part;

an inner cylinder part disposed inside the outer cylinder part; and a projection projecting outward from the outer cylinder part in a radial direction of the rotation axis, the insertion space includes:

a cylindrical space in which the coil part is disposed;

a projection space in which the outer projection is disposed; and an inside space, and the projection includes the projection space, the first positioning part includes an inner surface of the of the projection space, the third positioning part includes at least one of the inner cylinder part and the outer cylinder part, and the second positioning part is disposed in the shaft part inserted in the insertion space and includes a slit in which the inner projection is disposed.

* * * * *